United States Patent [19]

Coleman

[11] 4,027,197

[45] May 31, 1977

[54] VARIABLE BAR DISPLAY TUBE USING INSULATED ELECTRODES

[75] Inventor: William E. Coleman, St. Charles, Ill.

[73] Assignee: NCR Corporation, Dayton, Ohio

[22] Filed: Oct. 8, 1975

[21] Appl. No.: 620,903

[52] U.S. Cl. ..... 315/169 TV; 340/168 S; 340/173 PL; 340/324 M

[51] Int. Cl.[2] ..... H05B 41/14; H05B 37/00

[58] Field of Search ..... 315/169 TV, 169 R; 340/324 M, 324 R, 166 EL, 168 S, 173 PL

[56] References Cited

UNITED STATES PATENTS

| | | | |
|---|---|---|---|
| 3,781,600 | 12/1973 | Coleman et al. | 315/169 TV |
| 3,911,422 | 10/1975 | McDowell et al. | 340/324 M |

*Primary Examiner*—Eugene R. La Roche
*Attorney, Agent, or Firm*—Lowell C. Bergstedt; James P. Ryther

[57] ABSTRACT

A plasma glow tube for displaying a bar of selectable length comprises an insulating enclosure filled with an ionizable gas. The enclosure may have flat opposing sides, the inside walls of which have conductive electrodes (preferably transparent) deposited thereover in a staggered pattern such that each electrode, except the end ones, is positioned between and equidistant from two opposing electrodes. The electrodes, except for the first and last electrodes which are DC coupled to the gas, are all covered with an insulating layer so that they are insulated from the gas. A potential difference, preferably in the form of a pulse, is applied between first and second end electrodes to ionize the gas therebetween and leave an inside wall charge adjacent said second electrode. A pulse is applied between the charged electrode and the next succeeding, opposite (third) electrode to ionize the gas therebetween and leave a charge on the third electrode, and so on. After the charge has been partially shifted to its desired location, i.e., over a predetermined number of electrodes, the first and second electrodes are again pulsed, creating a second charge which is in turn shifted, in synchronism with the first charge. Thereafter equally spaced third and succeeding charges are created and shifted in succession. When the first charge reaches the desired electrode according to the desired length of the bar to be displayed, it and the succeeding charges are shifted backward and forward repetitively in tandem over the next preceeding, predetermined number of electrodes at a rapid enough rate so that all groups of predetermined electrodes appear to glow continuously, whereby the entire gas from the first to the desired electrode appears to glow continuously. Isolated segment or segments of the gas can also be made to appear ionized continuously by other modes of pulsing and charge manipulation.

12 Claims, 5 Drawing Figures

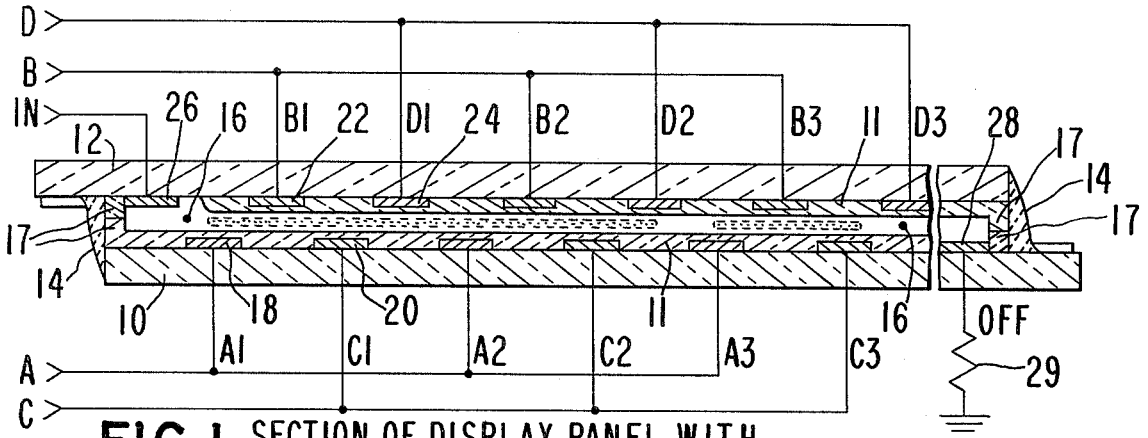
FIG. 1 SECTION OF DISPLAY PANEL WITH BAR & SEGMENT DISPLAYED
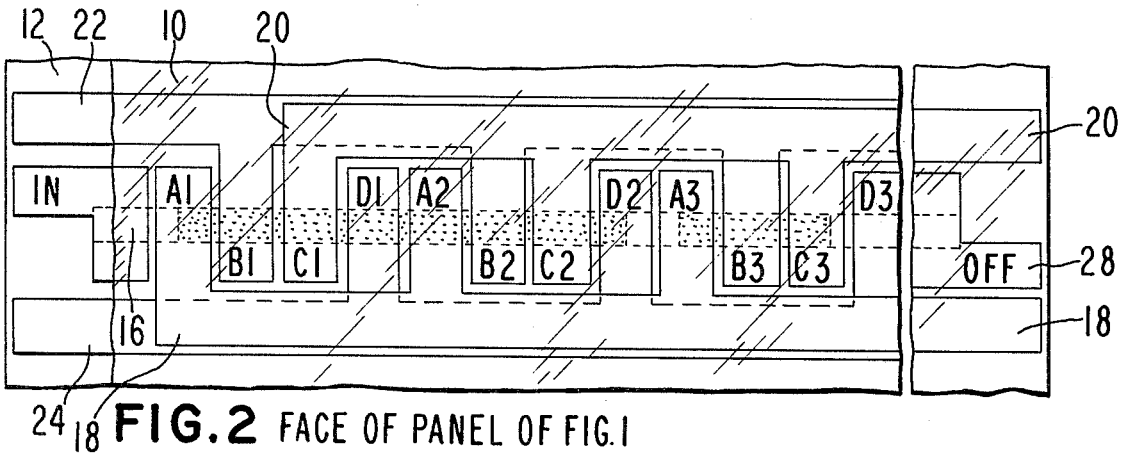
FIG. 2 FACE OF PANEL OF FIG. 1
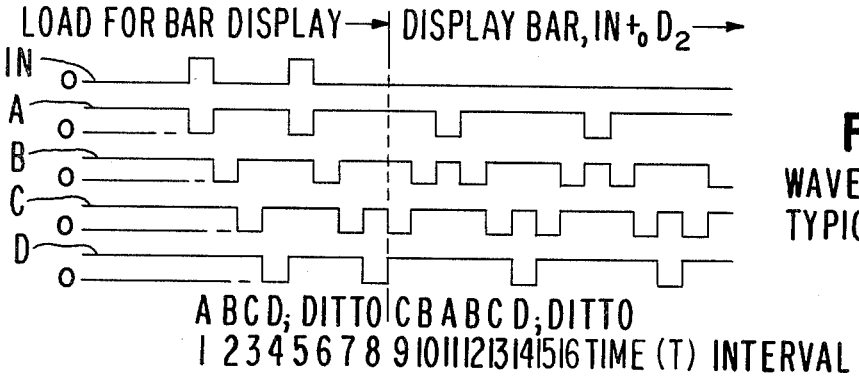
FIG. 3 WAVEFORMS FOR TYPICAL BAR DISPLAY
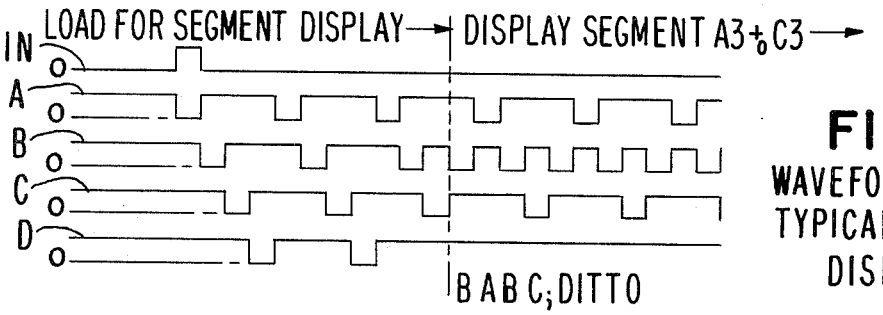
FIG. 4 WAVEFORMS FOR TYPICAL SEGMENT DISPLAY

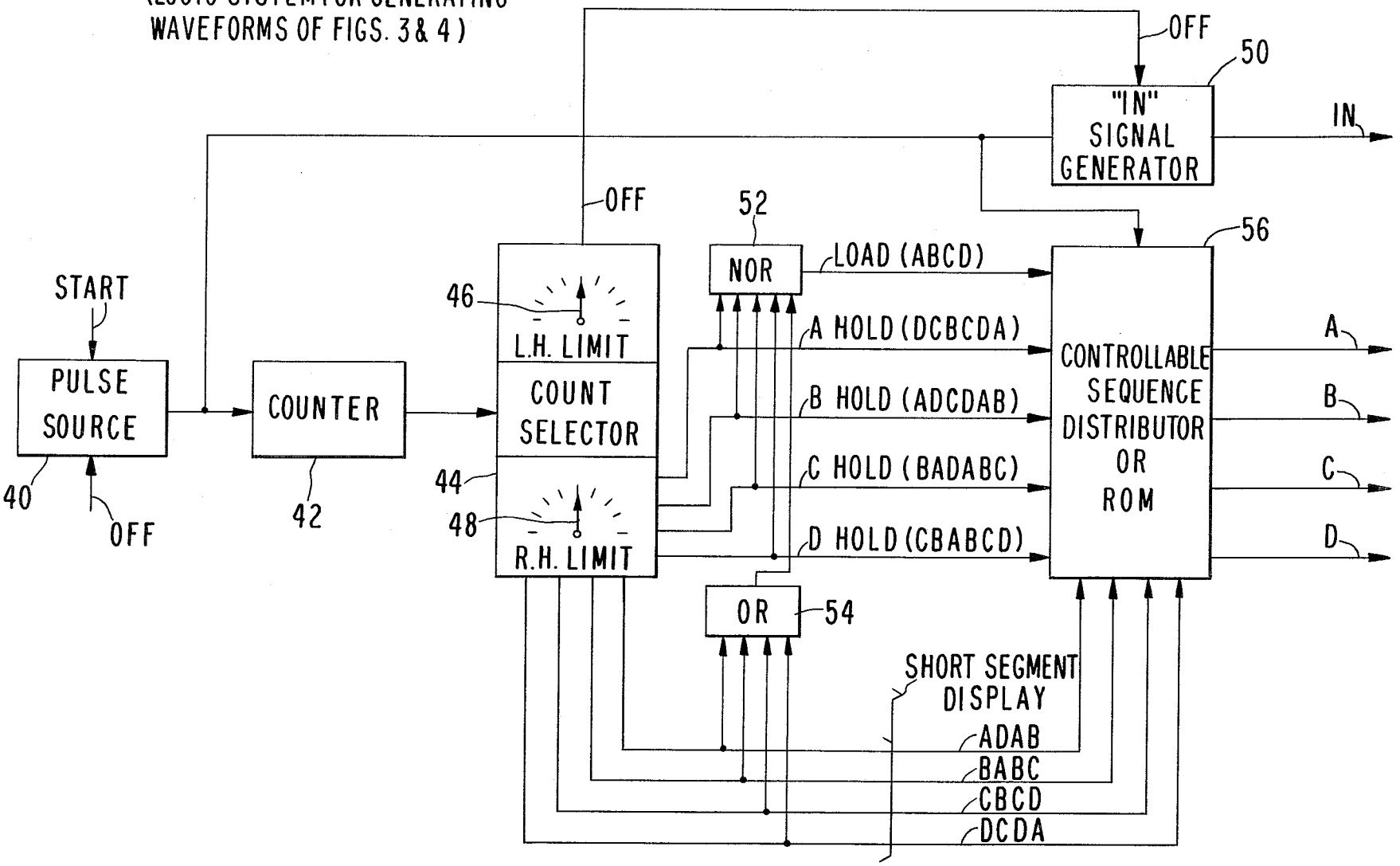
FIG. 5 BLOCK DIAGRAM OF DRIVER (LOGIC SYSTEM FOR GENERATING WAVEFORMS OF FIGS. 3 & 4)

VARIABLE BAR DISPLAY TUBE USING INSULATED ELECTRODES

FIELD OF INVENTION AND DESCRIPTION OF PRIOR ART

Plasma display tubes have long been used for displaying information in the form of characters or other symbols. Such tubes generally comprise an ionizable gas in an envelope with electrodes connected to apply an electrical field across the gas, thereby to ionize the gas (cause it to glow) between or adjacent the electrodes so that the gas will emit characteristic radiation.

The most common and widely known type of plasma display tube is the so-called d.c. (direct current) type of tube in which the electrodes are inside the envelope in direct contact with the gas. This type of tube works well except for a tendency of the cathode (negative) electrode to sputter due to bombardment by ions during operation. Although such sputtering can be partially alleviated by the addition of a small quantity of mercury or other heavy molecules as taught by Pintsch in, e.g., U.K. Pat. No. 155,783, accepted Apr. 28, 1921, it is still a problem. Also the d.c. type panel has no inherent memory and additional means must be included to provide a memory capability.

Recently a.c. (alternating current) type plasma display tubes have appeared. This type comprises an envelope containing an ionizable gas with conductive electrodes on the inside of the envelope and insulated from the gas, but capacitatively coupled thereto. When a sufficient potential difference is applied across the electrodes, the field therefrom will cause the gas to ionize between such electrodes, emitting characteristic radiation. During such ionization, current will flow, charging the capacitance between the electrode and the gas so as to build a potential which opposes the potential difference across the gas. This will cause the potential difference across the gas to rapidly fall below the required sustaining level, whereupon the ionization will quench so that only a characteristic "pip" of light will occur, even if the potential difference is continued to be maintained across the electrodes.

Due to the fact that a charge remains adjacent one of the electrodes on the inside of the envelope, a potential difference applied across the electrodes in the reverse direction will be aided by the potential due to such charge so that the gas between the electrodes can be re-ionized, creating another pip of light in the manner aforedescribed. Due to the potential caused by the charge, the reverse potential and all subsequent potential differences need not be as great as the initial potential difference to ionize the gas.

Also in the a.c. tube, by initially firing a portion of the gas between two electrodes and applying a subsequent a.c. potential thereacross, successive pips of light can be created which, if rapid enough, will appear to be continuous.

Since in the a.c. display panel no metal electrode is ever in contact with the gas, sputtering is markedly reduced, thereby providing far superior longevity than that found in d.c. display tubes, even if they contain mercury.

One such a.c. display tube is shown in U.S. Pat. No. 3,781,600, dated Dec. 25 1973, of the present inventor and Kessler. However, in the device of this patent it is difficult to display a continuous bar of selectable length because the drive circuitry was not able to cause all of the gas throughout the length of the bar to appear to be continously ionized. The ability to display bars of selectable length is desirable since such bars can be used to indicate electronic parameters (e.g., voltage, current), or other variables or quantities without the need for moving mechanical elements, as would be required in conventional meters.

D.c. bar graph display tubes are available, but in these, only portions which extend from one end of the bar can be illuminated. Also longevity is a problem due to cathodic sputtering, aforenoted.

PRESENT INVENTION

The present invention provides a bar graph display wherein an a.c. display panel is used and which can provide a bar graph display wherein the gas extending between any pair of electrodes can be made to appear to be continously lighted, the bar can be made to extend to any length from one end or the other end of the tube, and segments of any length and position can be illuminated with relatively simple driving circuitry which requires no special memory other than that needed to provide a few fixed driving signals.

Accordingly, several objects of the present invention are: (1) to provide a novel display apparatus, (2) to provide an a.c. display apparatus which can display bar graphs of various lengths and positions, and (3) to provide a display apparatus which can display bar graphs and has great longevity, low power consumption, is simple to construct, and is highly reliable. Further objects and advantages of the present invention will become apparent from a consideration of the ensuing description thereof.

DRAWINGS

FIG. 1 shows a section of a display panel according to the invention. FIG. 2 shows the face of the panel of FIG. 1. FIG. 3 shows waveforms required to generate a typical bar display. FIG. 4 shows waveforms required to generate a typical segment display. FIG. 5 shows a block diagram of one driver which is capable of generating the waveforms of FIGS. 3 and 4 for driving the panels of FIGS. 1 and 2.

REFERENCE NUMERALS

10 front glass plate
11 dielectric coating
12 rear glass plate
14 frit seal
16 gas volume
18 "A" electrode
20 "C" electrode
22 "B" electrode
24 "D" electrode
IN electrode
28 OFF electrodes
29 ground resistor
40 pulse source
42 counter
44 count selector circuit
46 left limit set dial
48 right limit set dial
50 IN signal generator
52 NOR gate
54 OR gate
ROM

FIGS. 1 and 2—DESCRIPTION

The display panel or tube of FIGS. 1 and 2 comprises two glass plates 10 and 12. Plates 10 and 12 are spaced apart to provide a volume therebetween which is filled with an ionizable gas 16. Gas volume 16 is confined to a bar shape, as will be described infra. The glass plates are sealed together by the usual frit seal 14 so that gas 16 is sealed from the ambient.

Gas 16 may preferably be composed of any one or a mixture of the following gases: neon, argon, helimn, krypton, xenon, hydrogen, nitrogen. The preferred mixture is either pure neon or neon plus or more of the others, for example 99.9% neon with 0.1% hydrogen at a pressure of about 0.5 atmosphere. Such mixture will provide an orange-colored glow when ionized. The thickness of each of the glass panels 10 and 12 is about 3 mm (0.125 inch) and the space therebetween may be from 130 microns (0.005 inch) to 1 mm (0.040 inch) depending on the width and pitch of the transfer electrodes A, B, C, D, to be described. The height of the bar-shaped gas volume 16 as viewed in FIG. 2*d* and be from 900 microns (0.030 inch) to 3 cm (1 inch) or more. The inside walls of the tube adjacent gas 16 may be coated with magnesium oxide in order to improve the performance of the tube.

The inside faces of glass plates 10 and 12 have deposited thereover conductive and preferably transparent electrodes, e.g., of Sn0, in the pattern indicated in the drawing. Specifically, the inside of front glass plate 10 has formed thereover "A" and "C" electrodes 18 and 20, respectively, the "A" electrode 18 consisting of a horizontal buss bar with vertical extensions projecting upwardly therefrom and the "C" electrode 20 consisting of another horizontal buss bar on the opposite side of gas volume 16 with vertical projections or arms extending downwardly therefrom. The arms of electrodes 18 and 20 are interdigitated and cross over the portion of the tube occupied by gas 16. For purposes of clarity of illustration, the horizontal or buss portions of electrodes 18 and 20 are shown schematically in FIG. 1. Electrodes 18 and 20 are coated with a thin dielectric glass 11 about 13 microns (0.0005 inch) to 25 microns (0.001 inch) in thickness; such dielectric glass may be formed of a silk-screened glass paste.

Similarly, the inside surface of rear glass plate 12 has deposited or formed thereover "B" and "D" electrodes 22 and 24, the arms of which are interdigitated with each other and with those of electrodes 18 and 20 in the manner indicated. In order to provide clarity of illustration, electrodes 22 and 24 are shown in FIG. 2 offset vertically from electrodes 18 and 20, although they preferably have the same vertical positions. Electrodes 18 and 20 are also coated with the thin dielectric glass 11.

Dielectric coating glass 11 may be formed of a sufficient thickness at the ends 17 thereof to hold plates 10 and 12 the prescribed distance apart and may also be configured in thickness along the lengths thereof to define a bar-shaped volume across the center of the panel for containing gas 16.

Only three sets of arms for each of electrodes A to D are shown in FIGS. 1 and 2, but in practice many more sets would be provided, as indicated by the discontinuity at the right of these figures. For example, one embodiment had glass plates 250 cm (10 inches) long and each electrode had 192 arms. The arms of the electrode 18 are designated A1, A2, and A3; the arms of B electrode 22, B1, B2, and B3; etc.

Note from FIGS. 1 and 2 that each arm of the B electrode is opposite the space between the arm of an A electrode and a C electrode; each D arm is opposite the space between a C arm and an A arm; each C arm is opposite the space between a B arm and a D arm; and each A arm is also opposite the space between a B arm and a D arm. Thus it can be seen that, starting with the first A arm, A1, a zig-zag path can be traced back and forth across the gas volume as follows: A1, B1, C1, D1; A2, B2, etc.

In addition to the A, B, C, and D electrodes, a single input electrode, labeled "IN" and designated 26, is deposited on the inner side of glass plate 12 in a position where a D arm would be, and an "OFF" or erase electrode 28 is formed inside front glass plate 10 in the position where an A arm would be. Both the IN electrode and the OFF electrode are not coated with the dielectric glass layer in order to avoid charge buildup thereover. IN and OFF electrodes 26 and 28 have separate electrical connections thereto, whereas all arms of the A electrode, all B arms, all C arms, and all D arms are commonly connected by their horizontal buss bars. The display panel thus has the following six connections: IN, A, B, C, D, and OFF. OFF electrode 28 is connected to ground by a resistor 29 whose value may be about 10 megohms.

Front and rear plates 10 and 12 may be of identical length but are preferably mounted in a mutually overlapping arrangement as shown in FIG. 1 so that the buss lines of each electrode can terminate at a pad at the exposed inner faces of the plates, as indicated at the right and left of FIG. 2. The tube may also contain additional pairs of directly opposing continuous glow therebetween in order to insure that a supply of ions will be continuously present in gas volume 16 in order to insure reliable operation of the tube.

GENERATION OF BAR DISPLAY (FIG. 3)

Gas 16 in FIG. 1 is shown ionized in two sections: (a) a continuous bar section extending from arm A1 to arm D2, and (b) a segment section extending between arms A3 to C3. The input waveforms for generating the bar display are shown in FIG. 3 and the input waveforms for generating the segment display are shown in FIG. 4. The bar and segment displays would normally be generated at separate times, and will be so described, but could be generated at the same time as illustrated.

To generate the bar display extending from A1 to D2 it is necessary first to apply "load" waveforms, shown at the lefthand side of FIG. 3 to the IN, A, B, C, and D terminals until a charge is shifted adjacent the desired arm (D2) to which the right edge of the bar is to extend, whereafter a predetermined pattern of "display" waveform, as shown at the righthand side of FIG. 3, are applied to only the A, B, C, and D electrodes in order to create a time division multiplex type ionization of the gas which makes it appear that the entire gas volume from A1 to D2 is continuously ionized.

The operation of the display can best be understood by referring to FIGS. 1 and 3. The following operation will be described in two parts: (I) the Load Mode, and (II) the Display Mode. In each part, or mode, the pulses which are applied during the time intervals (T1, T2, etc.) indicated at the bottom of FIG. 3 will first be described, and then the events which take place in the tube in response to that pulse or pulses will be described. The temporal width of each of the "T" intervals is preferably about 20 microseconds and the entire Load Mode takes about 80 microseconds. Each negative-going pulse shown in FIGS. 3 and 4 should represent a potential charge of about 140 volts, and the positive-going "IN" pulses should be about 180–200 volts. As indicated, the IN termininal is normally held 0 volts and the A, B, C, and D terminals are normally held at a positive potential (140 volts).

The tube may be appropriately masked or shielded by means (not shown) so that only the usable portion of gas volume 16 will be viewable to an observer.

LOAD MODE

T1— Positive pulse applied to IN terminal and negative pulse (ground) applied to A terminal.

Prior to T1, the A terminal was at +140 V and the IN terminal was at ground. This 140 volt difference was insufficient to ionize the gas between the IN terminal and the A1 electrode.

When the IN terminal is pulsed positive (180 to 200 V) and the A terminal is grounded, the potential difference between IN and A1 will rise to a value sufficient to cause the gas between these two arms to ionize and glow, creating a positive charge adjacent the grounded arm (A1) and tending to create a negative charge on the positively driven electrode (IN), which, being dc coupled, will not charge. The positive charge which builds up on the inside wall of the tube adjacent arm A1 will oppose the applied potentials on the IN and A1 arms so that the net field applied across the gas quickly will be reduced to below that needed to sustain ionization of the gas, whereupon the gas will extinguish, thus creating the characteristic "pip" of light and leaving a positive charge on the inside wall adjacent A1.

The ground applied to the A terminal will of course be applied to all of the other A arms shown in FIG. 1, namely, A2 and A3, but no gas will be ionized adjacent either of these arms because the potential on the arms opposite A2 and A3, i.e., the potential on arms D1 and B2 with respect to A2 and D2 and B3 with respect to A3, although positive (140 V), will be insufficient to ionize the gas.

T2— Ground pulse applied to B terminal.

All of the B arms will go to ground. Since a high positive charge is already adjacent A1, the field across the gas between A1 and B1 will be sufficient to ionize this portion of the gas, creating a second pip of light and leaving a high positive charge adjacent B1 and a negative charge adjacent A1.

T3— Ground pulse applied to terminal C.

This pulse will cause the gas between B1 and C1 to ionize, leaving a charge adjacent C1.

T4—Ground pulse applied to terminal C.

This pulse will cause the gas between C1 and D1 to ionize, leaving a positive charge adjacent D1.

T5— Positive pulse applied to IN terminal and ground pulse applied to A terminal.

This pulse will cause the gas between IN and A1 to ionize again. Also, since a positive charge has been left adjacent D1, the gas between D1 and A2 will also ionize. Positive charges will be left adjacent A1 and A2.

T6— Ground pulse applied to B terminal.

This pulse will cause the gas between A1 and B1 to ionize and also the gas between A2 and B2 to ionize.

T7— Ground pulse applied to C terminal.

This pulse will cause the gas between B1 and C1 to ionize and also the gas between B2 and C2 to ionize.

T8— Negative pulse applied to D terminal.

This will cause the gas between C1 and D1 to ionize and also the gas between C2 and D2 to ionize.

It will be thus seen that in the Load Mode, terminals A, B, C, and D are given sequential or ground pulses and a positive pulse is applied to the IN terminal each time the A terminal is grounded. A series of "pips", each spaced four arms apart, will appear to progress down the tube. These input voltage pulses should be applied until the first pip has in effect progressed to the arm at which the end of the bar is to extend. In the present example, since the end of the bar is to extend to electrode D2, the Load Mode is terminated after the D terminal is pulsed a second time. The tube is then energized in accordance with the Display Mode pulses indicated at the right side of FIG. 3, as will now be described.

II— Display Mode

During the Display Mode, as indicated at the right side of FIG. 3, the IN terminal is not pulsed; only the A, B, C, and D electrodes are pulsed (grounded), repetitively, in the following sequence: C-B-A-B-C-D. This will cause the ionized portion of gas to appear to circulate between pairs of each set of four adjacent arms (A-B-C-D) so that the entire bar of gas between electrodes A1 and D2 will appear to be continuously ionized. This can be better understood by reference to the following continuation of the previous description of the mode of operation. It will be recalled that at the end of the load mode, the D terminal had been grounded, causing the gas between C1 and D1 as well as the gas between C2 and D2 to ionize, leaving positive charges adjacent D1 and D2.

T9— C terminal grounded.

The negative pulse will be applied to all of the C arms, but since only D1 and D2 have adjacent positive charges, only the gas between C1 and D1, and C2 and D2, will ionize, thereafter leaving a positive charge adjacent C1 and C2.

T10— B terminal grounded.

The ground applied to the B terminal, in conjunction with the positive charge on C1 and C2, will cause the gas between B1 and C1, as well as the gas between B2 and C2 to ionize, leaving positive charges adjacent B1 and B2.

T11— A terminal grounded.

This will cause the gas between A1 and B1, as well as the gas between A2 and B2, to ionize, leaving positve charges adjacent A1 and A2.

T12— terminal grounded.

This will cause the gas between A1 and A1, as well as the gas between A2 and B2 to ionize, thereafter leaving positive charges adacent B1 and B2.

T13— C terminal grounded.

This will cause the gas between B1 and C1, as well as the gas between B2 and C2, to ionize, thereafter leaving positive charges C1 and C2.

T14— D terminal pulsed negatively.

This will cause the gas between C1 and D1, as well as the gas between C2 and D2, to ionize, thereafter leaving positive charges adjacent D1 and D2, similar to those present at start of the Display Mode.

In succeeding sets of six intervals, the terminals C-B-A-B-C-D are again pulsed in sequence, causing the ionized portion of the gas to appear to circulate from adjacent each D arm, where it was initially ionized, back to the next succeeding A arm and forward again to the D arm. By making this effective recirculation of the ionized portion of the gas occur at a rapid enough rate, the entire portion of the gas between the set of four adjacent arms, A, B, C, and D, will appear to be continuously ionized so that the entire gas volume between A1 and D2 will appear to be continuously ionized.

The ionized bar can be extended to any position desired merely by terminating the Load Mode after the arm adjacent the desired end of the bar is ionized and applying suitable Display Mode pulses similar to those shown at the right side of FIG. 3.

Specifically, if the last arm to which the ionized bar is to extend is a D arm, during the hold mode the electrodes should be pulsed in the following sequence: C-B-A-B-C-D as shown in FIG. 3. If the last arm is to be a C arm, the following hold sequence should be used: B-A-D-A-B-C. If a B electrode, the sequence would be as follows: A-D-C-D-A. And if an A arm, the sequence would be as follows: D-C-B-C-D.

Apparatus for generating Load Mode pulses and the Display Mode pulses as described will be readily designable by anyone skilled in the computer or logic circuit arts, but one suitable system is shown in FIG. 5 and will described infra, after the generation of a segment display is described.

GENERATION OF SEGMENT DISPLAY (FIG. 4)

To ionize a "segment" of gas 16, i.e., a portion thereof which is spaced from both ends of the tube, it is necessary to use a slightly different waveform to load the display and a somewhat different form to display the segments. As stated, it will be assumed that it is desired to display the segment shown in FIG. 1, which extends from arm A3 to arm C3.

LOAD MODE

As shown at the left C of FIG. 4, during the load mode, pulses are applied to the tube similar to those for loading for a bar display, as shown at the left side of FIG. 3, except that only one pulse is applied to the IN terminal and, since the right edge of the segment is to occur at arm C3, the Load Mode is terminated after the third c pulse is applied.

As will be apparent from an understanding of the Load Mode of FIG. 3, the operation of the Load Mode of FIG. 4 is identical, except that only one ionized portion of gas is shifted down the tube since only one pulse is applied to the IN terminal. This portion will be shifted down to C3, whereafter it will self-extinguish in the usual fashion and a positive charge will be left opposite arm C3.

Display Mode

During the Display Mode, as controlled by pulses at the right side of FIG. 4, the ionized portion of gas is recirculated between arms C3 and A3 in the same manner as was the ionized portion shifted between arms D2 and A2 in conjunciton with the bar display. Thus the first terminal to be grounded in the display mode is the B terminal, which causes the portion of gas between C3 and B3 to ionize, leaving a positive charge on B3. Thereafter an A ground is applied, causing the gas between B3 and A3 to ionize. Then another B ground is applied, reionizing the gas between A3 and B3, and lastly a C ground is applied, reionizing the C3-B3 gas. This sequence is repeated at a rapid enough rate to cause all of the gas between A3 and C3 to appear to be continuously ionized, as indicated at the right side of FIG. 1.

If it is desired to display a segment longer than four electrodes, during the Load Mode plural pulses should be applied to the IN terminal as in FIG. 3 so that several recirculations can take place during the Display Mode, as with the Display Mode for a bar display. The length of the displayed segment can thus be adjusted as desired.

FIG. 5 — DRIVER

Although many types of drivers generating the waveforms of FIGS. 3 and 4 will be apparent to those skilled in the art, one specific form is presented in FIG. 5 for illustrative purposes.

The circuit of FIG. 5 comprises a pulse source 40 which generates, upon actuation of the START input thereof, a train of pulses. Such train terminates upon actuation of the OFF input thereof.

Counter 42, connected to receive output pulses from pulse source 40, provides a binary coded output indicative of the number of pulses which have been received from pulse source 40.

Count selector circuit 44 receives the count output from counter 40 and has a lefthand limit dial 46 and a righthand limit set dial 48, each of which is indexed to correspond with the arms on the display of FIG. 1. Thus the pointers of the dials 46 and 48 can each be set at any arm from Al to Dn, according to the desired length of the displayed segment. Specifically lefthand limit dial 46 is set according to the desired location of the left edge of the ionized section of gas and righthand limit dial 48 is set according to the desired location of the righthand edge thereof.

Count selector 44 has the following nine outputs: four "Short Segment Display" Outputs extending from the bottom thereof, labeled DCDA, CBCD, BABC and ADAB; four outputs from the right side thereof, labeled A HOLD (DCBCDA), B HOLD (ADCDAB), C HOLD (BADABC), and D HOLD (DBABCD); and one output from the top thereof; labeled OFF.

Count selector 44 functions to provide specified outputs according to the settings of left and right limit dials 46 and 48 when appropriate counts are reached. Specifically, assuming the bar of FIG. 1 is to be displayed and generated by the waveforms of FIG. 3, lefthand limit dial 46 would be set at A1 and righthand limit dial 48 would be set at D2. When sufficient pulses have been supplied to counter 42 so that it indicates to selector 44 that pulses sufficient to supply all of the Hold Mode pulses up to a D2 pulse have been supplied, count selector 44 will supply an output on the OFF lead and also an output on the D HOLD (CBABCD) lead.

If a segment is to be displayed from A3 to C3 as shown in FIG. 1, dials 46 and 48 are set to A3 and C3, respectively. When the desired count is reached so that enough pulses have been supplied to allow the ionized portion of the gas to be shifted adjacent the C3 arm, selector 44 will cause the BABC electrode to be energized in sequence. Also selector 44 will supply an output at the OFF lead thereof.

IN Signal Generator 50 is connected to receive pulses from source 40 and also to receive an OFF input from count selector 44. Generator 50 supplies positive "IN" pulses as shown in FIGS. 3 and 4 to the IN terminal of the tube of FIG. 1 in response to pulses from source 40 and in synchronism with the "A" pulses as shown in FIGS. 3 and 4. When OFF input of generator 50 is energized, the supply of IN pulses will be terminated.

The four right outputs of the count selector 44 are connected to four of the five inputs of a NOR gate 52, which as is well-known, supplies an output unless any of the five inputs thereto are energized.

The four Short Segment Display outputs of selector 44 are connected to an OR gate 54 whose output is connected to supply the fifth input of NOR gate 52. As is well-known, an OR gate supplies an output whenever one or more of the inputs thereto is energized and provides isolation between adjacent inputs thereof.

a controllable sequence distributor or ROM (read only memory) 56 is connected to the outputs or NOR gate 52 and all of the outputs of count selector 44 except the TOP output thereof. ROM 56 has four outputs, A,B,C, and D, which are connected to the four input terminals A,B,C, and D, respectively, of the tube of FIG. 1. The four outputs of ROM 56 are normally at a positive (140 volt) potential.

The sequence in which the four output terminals of ROM 56 are grounded is determined by the particular input of ROM 56 which is energized. Thus if the input of ROM 56 which is connected to the output of NOR gate 52 (labeled "LOAD (ABCD)" is energized, the outputs of ROM 56 will be grounded (repetitively) in the sequence A-B-C-D. For another example, if the input of ROM 56 labeled "D HOLD (DBABCE)" is energized, the outputs of ROM 56 will be repetitively grounded in the sequence C-B-A-B-C-D.

In operation, assume that the bar illustrated in FIG. 1, extending from arms A1 to A2, is to be displayed. Lefthand limit dial 46 would accordingly be set to A1 and righthand limit dial 48 would set to D2. since NOR gate 52 is receiving no input, it provides an output, causing ROM 56 to ground terminals A-B-C-D in alphabetical sequence. However, no portion of gas 16 will be ionized since no electrode of the tube has an adjacent charge and the A-B-C-D pulses will be insufficient, in and of themselves, to ionize any portion of the gas.

To initiate the display, the START input of source 40 is manually energized, whereupon pulses will be supplied from source 42 to generator 50, which will cause "IN" pulses to be supplied to the tube of FIG. 1. These pulses, in conjunction with the already supplied A-B-C-D pulses, will constitute the Load Mode pulses indicated at the lefthand side of FIG. 3; these will "load" the tube in the manner described.

When the set count of input pulses has been reached corresponding to the time when the second "D" pulse has been supplied, count selector 44 will sense this count in response to an input from counter 42, and will supply an output on its "D HOLD" output lead.

In response to the D HOLD output, ROM 56 will switch over to supplying a repetitive C-B-A-B-C-D input as indicated in the Display Mode at the right side of FIG. 3. Also, NOR gate 52 will receive an input and will thereupon terminate its output to ROM 56.

Thus the circuit will be shifted into the Display Mode and the bar display pattern illustrated in FIG. 1 will be visible.

If a segment is to be displayed, as illustrated at the right side of FIG. 1, lefthand limit dial 46 would be set to A3 and righthand limit dial 48 would be set to C3. After source 40 is started, and the first impulse is sent to the IN electrode of the display from generator 50, selector 44 will energize its OFF Output lead, energizing the OFF input of generator 50 and thereby terminating the supply of "IN" pulses.

When the ionized portion of the gas has reached the C3 arm, the BABC lead from selector 44 will be energized shifting ROM 56 into a mode which grounds the output leads thereof in the B-A-B-C pattern. The BABC lead also energize the input of NOR gate 52 via OR gate 54 so that the LOAD input of ROM 56 will be deenergized.

The segment as shown in FIG. 1 will accordingly be displayed indefinitely.

The diagram of FIG. 5 is a relatively simple logic diagram to illustrate one possible system for generating the required waveforms. It would be apparent to those skilled in the art that more complex logic systems can be readily provided to generate waveforms for energizing the display to show a plurality of segments in accordance with the invention. Also various other types of logic systems in addition to that shown in FIG. 1 can be provided.

It will be noted that the logic system of FIG. 5 is relatively simple since essentially a small number of waveforms will hold almost any possible pattern in the display. In effect, no separate memory is required for each type of display to be generated.

To extinguish or clear any display, it is merely necessary to put the drive into the load mode with no input applied to the IN terminal. This will cause the charges to shift down the tube to the right to the OFF electrode where they will be conducted to ground through resistor 29.

While the above description contains many specifities, these should not be construed as limitations upon the scope of the invention but merely as an examplication of several preferred embodiments thereof. For example, additional bars can be paralleled with the single bar shown and operated together to display characters or geometric fibures. The true scope of the invention is indicated by the appended claims and their legal equivalents.

I claim:

1. A display means comprising:

an envelope containing an ionizable gas, said envelope having opposed walls formed of an electrically insulating material, a plurality of conductive electrode arms, on said opposed walls of said envelope, said arms being capacitively coupled to said gas, said arms being mounted in staggered opposed positions on said walls, driver means for creating a charge within said envelope adjacent at least a first of said arms and for thereafter sequentially applying potentials to at least two sequential arms and said first arm such that the portions of said gas between mutually opposing pairs of at least said two sequential arms and said first arm ionze in sequential repetitive fashion at a rate rapid enough so that all of the gas extending between the extreme two of said arms appears to be ionized continuously to an observer.

2. The display means of claim 1 wherein said envelope is shaped to confine said gas in an elongated stripshaped volume, said opposed walls of said envelope defining at least portions of opposite major surfaces of said stripshaped volume, said conductive electrodes being formed on the inside surfaces of said opposed walls.

3. The display means of claim 1 wherein said opposed walls of said envelope are planar.

4. The display means of claim 1 wherein said driver means comprises first means for applying a potential difference between an initial pair of opposed arms across one part of said gas sufficient to ionize said gas and create an initial charge adjacent one of the arms of said pair and second means for sequentially applying potentials to successive adjacent arms to shift said initial charge and ionize the gas adjacent said successive arms until the gas adjacent said first of said electrode arms is ionized, thereby to create said charge within said envelope adjacent said first arm.

5. The display means of claim 4 wherein said first means also is arranged to apply successive potential differences between said initial pair of opposed arms to create succeeding initial charges on said one of said arms of said pair and said second means is arranged to apply successive potentials to said successive adjacent arms to shift said succeeding initial charges and successively ionize the gas adjacent said successive arms.

6. The display means of claim 5 further including means for recirculating (a) the charge adjacent said one arm and a given plurality of succeeding arms and (b) at least the charges on the arm next succeeding ones of said given plurality of succeeding arms and a similar given plurality of further succeeding arms so that the gas adjacent all of said arms is successively ionized at a rate rapid enough so that a continuous glow adjacent all of said arms will appear to an observer.

7. A controllable display, comprising:

a. an enclosure containing an ionizable gas and having a plurality of spaced electrode arms on each of two opposing sides of said enclosure, said arms being capacitively coupled to said gas, at least each of the arms on each side of said enclosure except a first and a last being positioned adjacent at least two arms on the opposite side of said enclosure such that the gas between each said arm and either of said two adjacent opposite arms can be ionized by applying a given potential across such opposing arms, b. means for supplying operating potentials to said arms for sequentially and repetitively ionizing the portions of said gas between adjacent pairs of opposing arms of any given continuous group of at least three arms at a rate rapid enough so that the entire gas volume extending across said continuous group of arms appears to an observer to be ionized.

8. The display of claim 7 wherein said means for supplying operating potentials comprises a plurality of bus lines, each connected to a plurality of nonadjacent arms on one side of said display.

9. The display of claim 8 wherein said means for supplying operating potentials comprises means for supplying a potential across an initial opposing pair of said arms for ionizing the gas between said arms and for thereafter sequentially supplying potentials across successive adjacent

10. The display of claim 7 wherein said means for supplying operating potentials also comprises selector switch means for selectably electrically connecting to a first of said arms and a second of said arms such that said first and second arms define said continuous group and said gas will appear to be continuously ionized between said first and second arms.

11. The display of claim 7 wherein said envelope also includes a first input electrode arm which is direct-current coupled to said gas.

12. The display of claim 11 wherein said envelope also includes a last, off electrode arm which is direct-current coupled to said gas.

* * * * *

UNITED STATES PATENT OFFICE

CERTIFICATE OF CORRECTION

Patent No. 4,027,197 Dated May 31, 1977

Inventor(s) William E. Coleman

It is certified that error appears in the above-identified patent and that said Letters Patent are hereby corrected as shown below:

Column 11, Claim 6, line 41, "charges" should be -- charge --; and

Column 12, Claim 9, line 30, after "adjacent" add -- pairs of opposing arms so that successive portions of said gas become sequentially ionized. --

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*